US005297493A

United States Patent [19]

Nuesmeyer et al.

[11] Patent Number: 5,297,493

[45] Date of Patent: Mar. 29, 1994

[54] BURN POT FOR PARTICULATE COMBUSTORS

[76] Inventors: David L. Nuesmeyer, N. 5530 Cannon, Spokane, Wash. 99205; Gary W. Brondt, 16220 S. Sherman Rd. #27, Cheney, Wash. 99004

[21] Appl. No.: 33,508

[22] Filed: Mar. 16, 1993

[51] Int. Cl.[5] ..... F23B 7/00

[52] U.S. Cl. ..... 110/233; 110/320; 126/67; 126/145

[58] Field of Search ..... 110/110, 320, 165 R, 110/169, 255, 233; 126/61, 67, 68, 73, 77, 79, 145

[56] References Cited

U.S. PATENT DOCUMENTS

| | | | |
|---|---|---|---|
| 3,027,855 | 4/1962 | Van Der Aue | 110/165 |
| 3,734,037 | 5/1973 | Martin | 110/165 R |
| 3,855,950 | 12/1974 | Hughes, Jr. et al. | 110/8 C |
| 4,020,773 | 5/1977 | Blach | 110/165 R |
| 4,048,928 | 9/1977 | Martin | 110/165 R |
| 4,884,515 | 12/1989 | Falconnet | 110/171 |
| 5,070,798 | 12/1991 | Jurgens | 110/110 |
| 5,123,360 | 6/1992 | Burke et al. | 110/233 |
| 5,133,266 | 7/1992 | Cullen | 110/233 |

FOREIGN PATENT DOCUMENTS 1166965 4/1964 Fed. Rep. of Germany .

*Primary Examiner*—Edward G. Favors

*Attorney, Agent, or Firm*—Wells, St. John, Roberts, Gregory & Matkin

[57] ABSTRACT

The present invention relates to a burn pot for particulate combustors, particularly of the type used for burning particulate fuel such as pellets. The burn pot includes a burn pot body surrounded by an air plenum in which air is delivered and exhausted through openings in side, front, and bottom walls of the burn pot body. A rearwardly inclined back wall is moved by a driver to reciprocate forwardly and rearwardly toward and away from the front wall. The back wall is inclined opposite to the front wall in order, upon reciprocating motion, to engage and move the particulate material toward the front wall, bunching it for more efficient combustion, clearing the openings in the burn pot walls, and forcing ash up the front wall and over the upper ash discharge edge thereof. The burn pot and back wall are removably mounted within the firebox to facilitate removal for cleaning, maintenance or replacement.

20 Claims, 8 Drawing Sheets

BURN POT FOR PARTICULATE COMBUSTORS

TECHNICAL FIELD

The present invention relates to burn pot construction and more particularly to burn pots used in particulate combustors such as pellet burning stoves.

BACKGROUND OF THE INVENTION

Pellet burning stoves have been found to be extremely efficient combustors with the predictable nature of the pellet fuel and the ability to control burning conditions within the fire box enclosures of such units. Combustion efficiency, due to the consistent size, material, and moisture content of the combustible particulates, may be controlled by specific design of the air feed systems and burn pots into which the pellets are fed in metered quantitites.

Combustion efficiency at high burn rates is a relatively easily achieved objective, due to the burn intensity and the ability to supply regulated combustion air to the burning product. Combustion efficiency at lower burn rates, however, is more difficult to achieve. Previous burn pots having a fixed internal volume must be designed for a maximum load of particulate fuel, thereby detracting from combustion efficiency at low burn rates. Such "typical" burn pots are excessively large for small amounts of fuel at low burn settings. A difficulty experienced at low burn is that the small amounts of fuel received within the burn pots is spread over a considerable surface area, leaving the individual combustible particulates to burn independently. Even with the fairly consistent nature of the combustible particulates, the individual particulates cannot be relied upon to burn evenly individually. Some will burn actively while others smolder or do not burn at all. A need has therefore remained for a burn pot in which provisions are made to facilitate high burn rates and that it will also function well to increase effective burning at low burn rates by accumulating the particulates in a desired mass.

Another difficulty with existing forms of burn pots is ash accumulation. This is especially true of certain combustible particulates that do not burn completely and leave excessive ash. The task of cleaning ash from the burn pots thus becomes a tedious chore. There therefore also remains a need for a burn pot that includes provision for cleaning ash and cinders from the burning area.

BRIEF DESCRIPTION OF THE DRAWINGS

A preferred form of the present invention is illustrated in the accompanying drawings in which.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
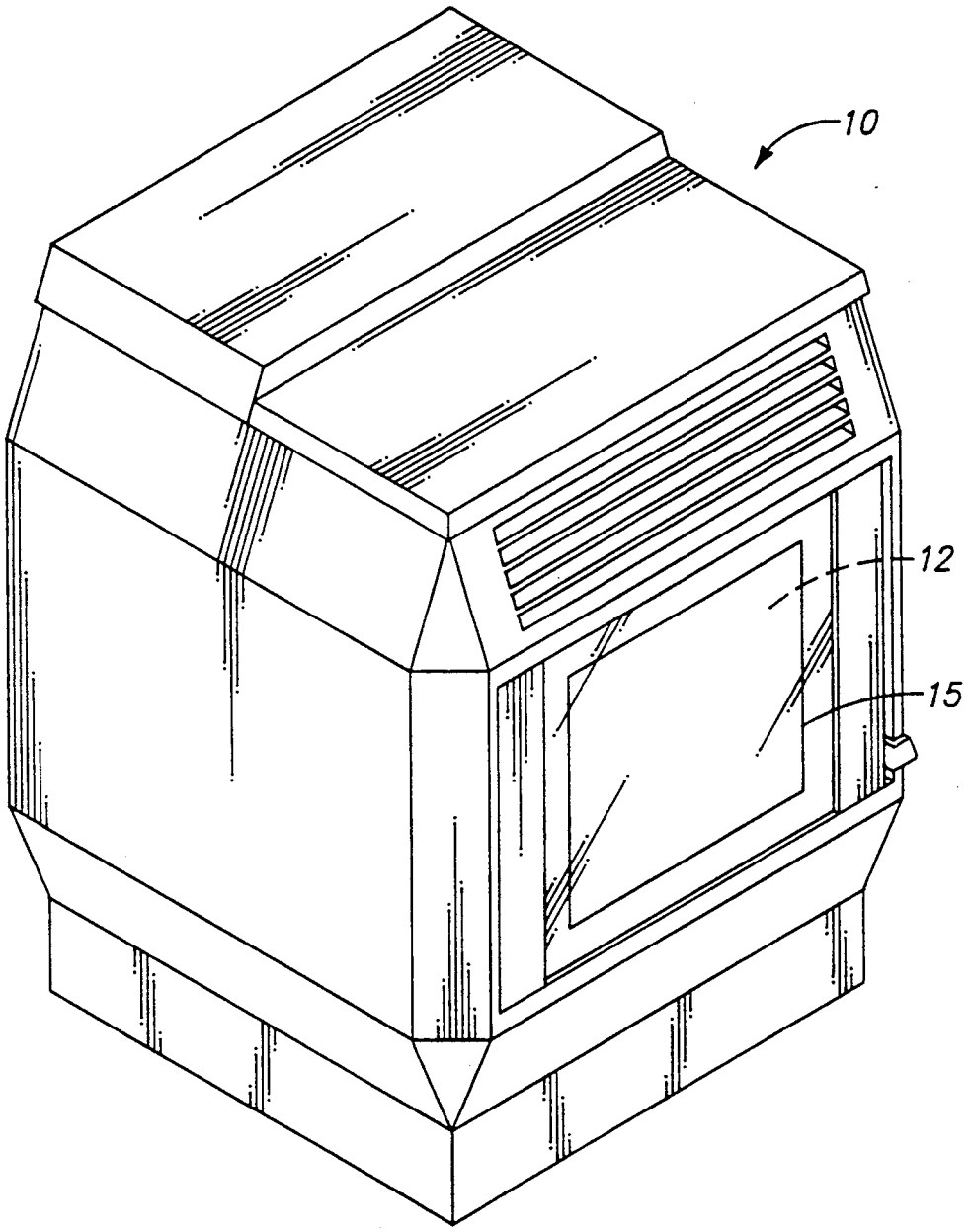
FIG. 1 is a perspective view of a particulate burner.
Figure 2:
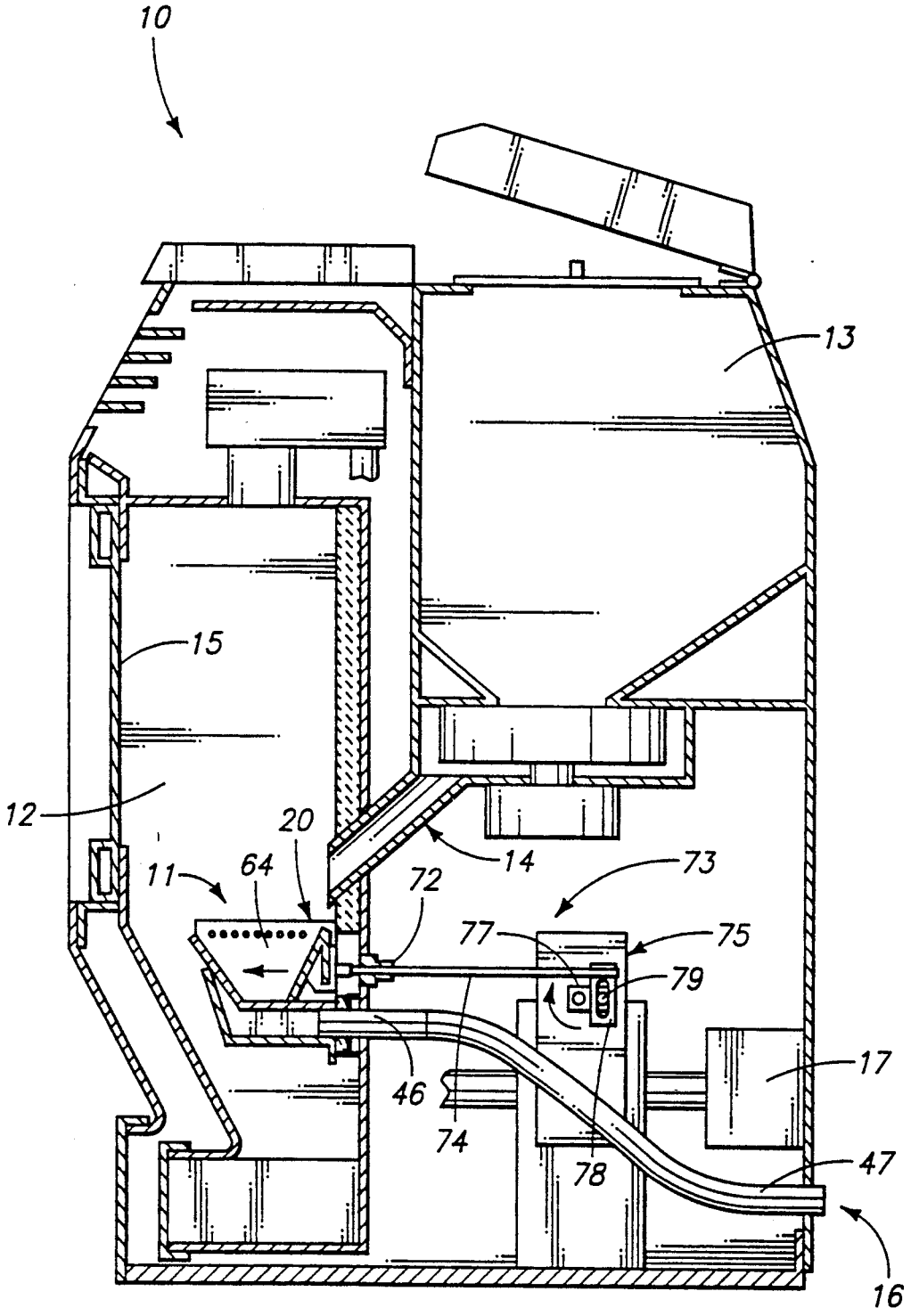
FIG. 2 is a diagrammatic sectional view through the burner showing placement of the present burn pot, also shown diagrammatically.
Figure 3:
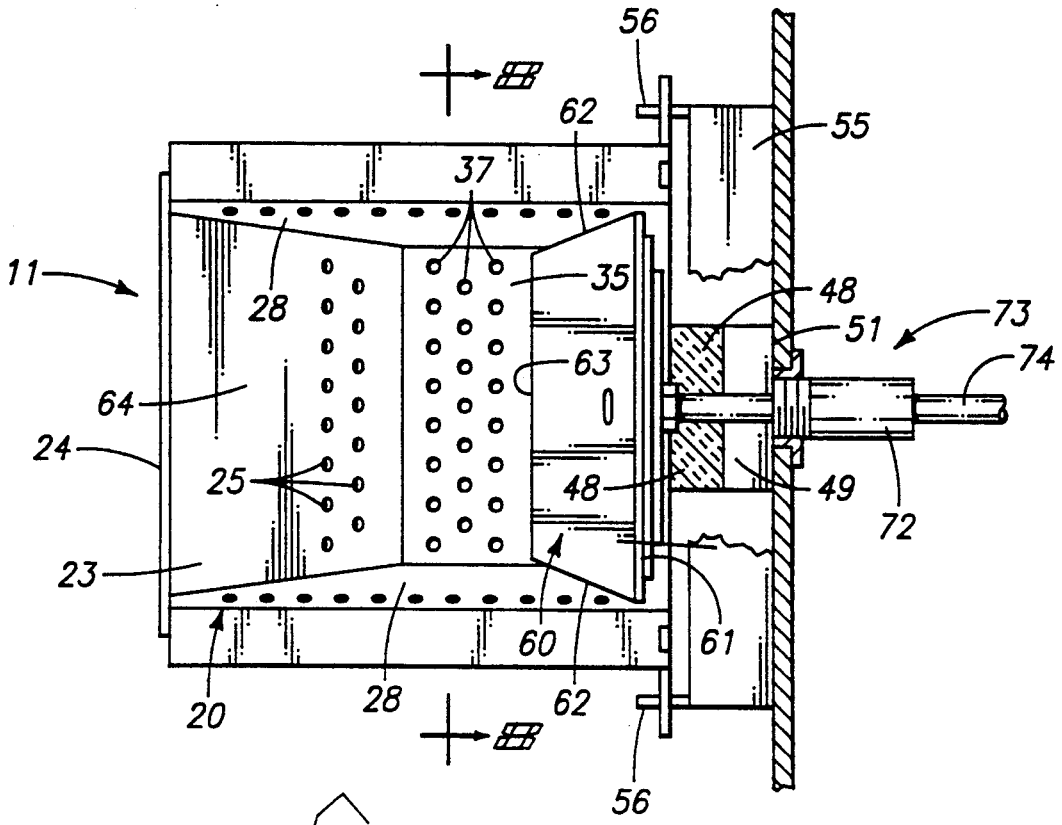
FIG. 3 is a top plan view of a first preferred form of the present burn pot.

In the drawings, a particulate burner is shown at 10 for use in conjunction with the present burn pot 11 which is generally shown within the combustor or burner 10 (which has been sectioned in FIG. 2). The burner 10 may be of the form illustrated in FIGS. 1 and 2, or may be other forms of burner in which a particulate hopper 13 is associated with a feeder mechanism 14 for selectively delivering controlled quantities of particulate fuel into a firebox area 12 by dropping the particulates downwardly into the present burn pot 11.

It should be understood that the configuration of the burner 10 shown in the drawings and as generally described is presented by way of example, it being understood that other forms of burners may also be utilized with the present burn pot.

The burner 10 includes the firebox 12 with an access door 15 at a forward side of the firebox, and a combustion air supply 16 which supplies air through provision of an induction fan 17 to deliver combustion air to the burn pot 11 and to draw the exhaust gases outwardly from the firebox.

Referring now in greater detail to the present burn pot 11, reference will be drawn more specifically to FIGS. 3–12 which illustrate the present burn pot 11 in greater detail.

The present preferred burn pot includes a burn pot body 20 which includes an inclined front wall 23 having an ash discharge edge 24 and combustion air supply openings 25 (FIG. 3) situated downwardly of the ash discharge edge 24.

The burn pot body 20 also includes side walls 28 that extend rearwardly from the front wall 23 to rearward edges 30. The side walls also include top edges 29 (FIGS. 4, 5) that are spaced slightly above the ash discharge edge 24 of front wall 23. Combustion air supply openings 31 are also supplied in the side walls 28 preferably adjacent the top edges 29.

The burn pot body 20 also includes a bottom wall 35. Bottom wall 35 is, in the preferred form, substantially horizontal and joins the front and side walls 23, 28 along bottom edges thereof. The bottom wall 35 extends to a rearward edge 36 that is substantially co-planar with the rearward side wall edges 30. The bottom wall also includes combustion air supply openings 37 spaced forward of the back wall 60 and rearward of the bottom edge of the front wall 23.

The side walls 28, front wall 23, and bottom wall 35 are preferably constructed of a durable metal such as stainless steel and are joined. The side walls and front wall are preferably inclined as shown in the sectional views (FIGS. 4, 5 and 8), with the front wall 23 being inclined such that the ash discharge edge 24 is spaced forwardly of and away from the bottom wall 35. The side walls 28 are also inclined, but are nearer vertical than the front wall 23. In a preferred example the front wall 23 is inclined at an angle of approximately 140° from the horizontal bottom wall 35. The front wall thus functions as a ramp which is convenient for upward migration of ash and cinder material during operation.

Figure 4:
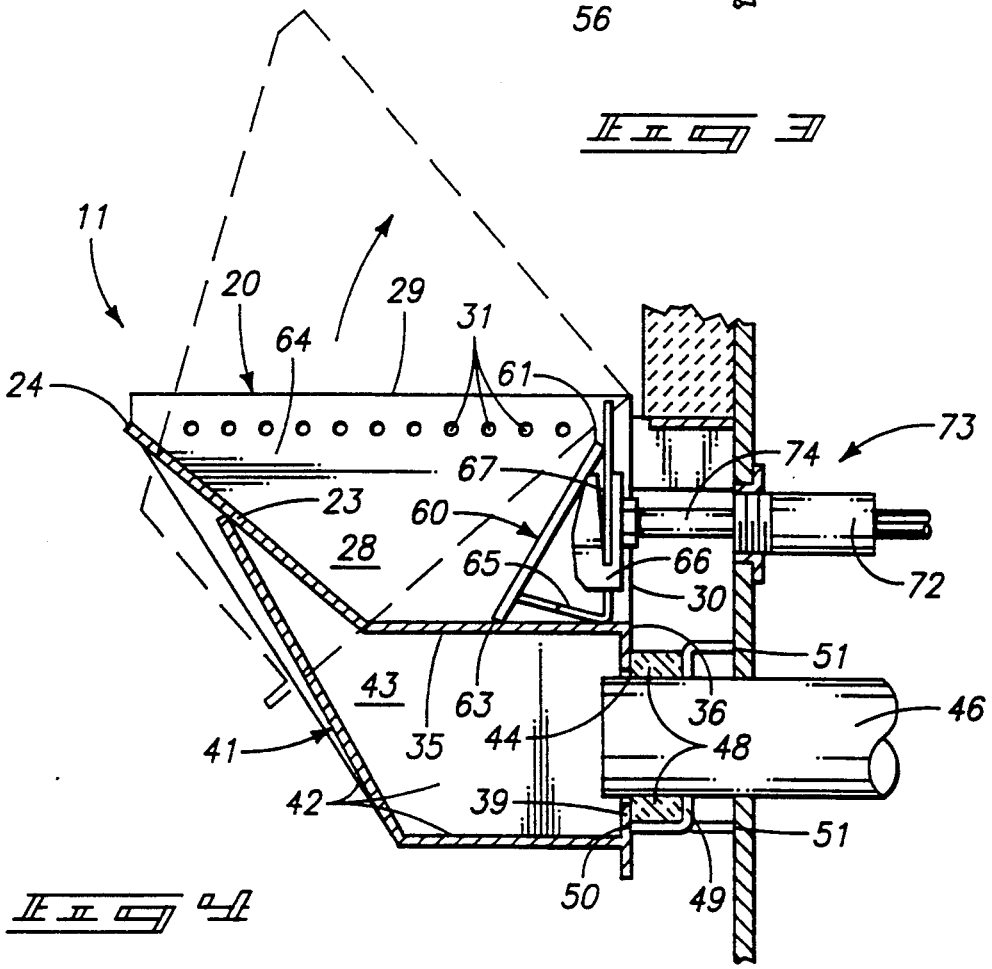
FIG. 4 is a longitudinal sectional view through the burn pot.
Figure 5:
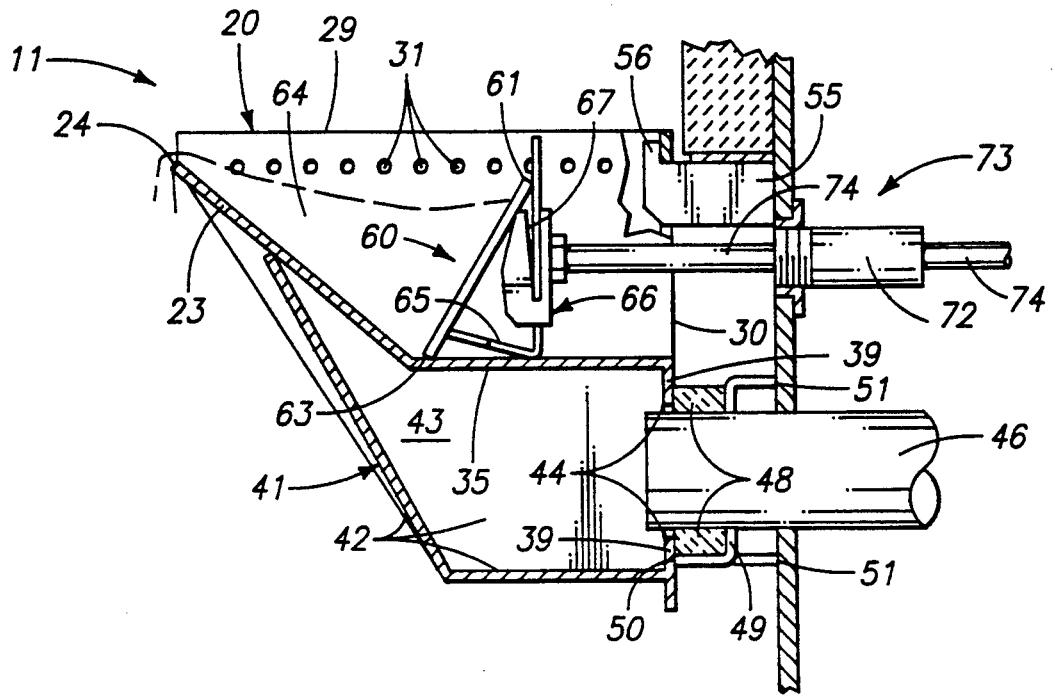
FIG. 5 is a view similar to FIG. 4 only showing the back wall in a forward position.
Figure 6:
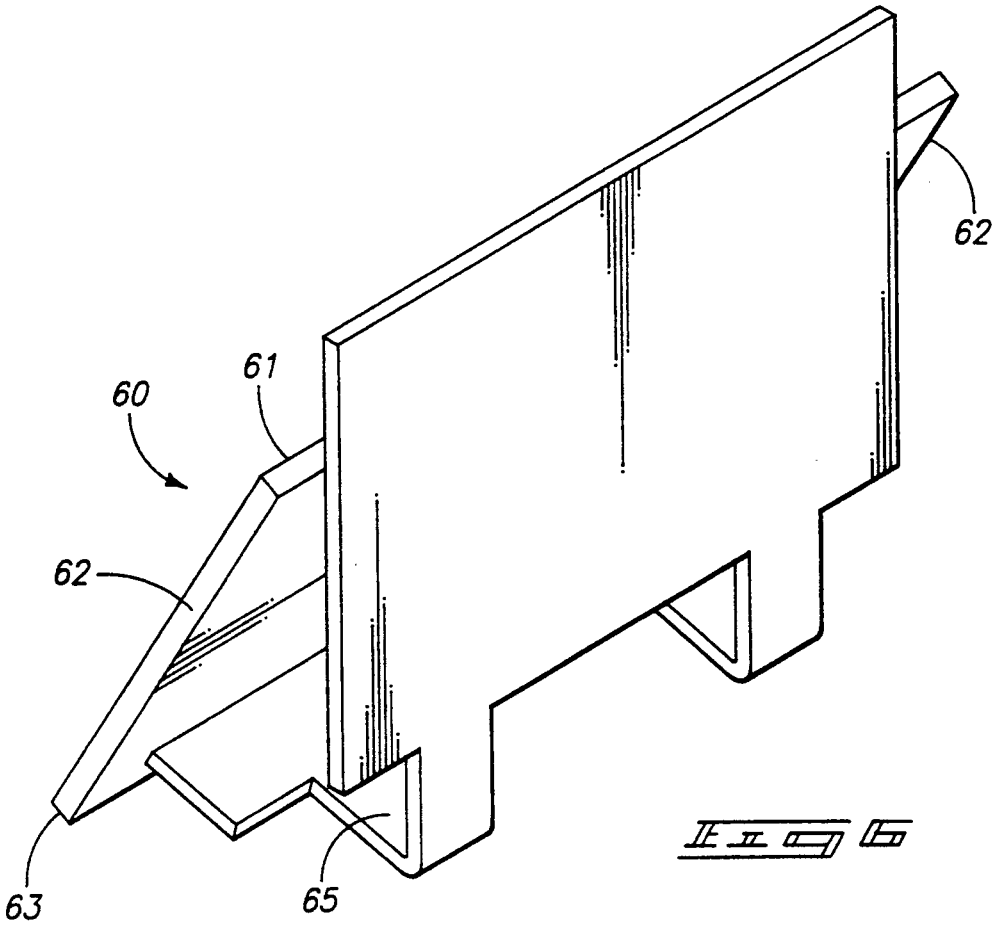
FIG. 6 is a perspective detail view of the back wall for the present preferred burn pot.
Figure 7:
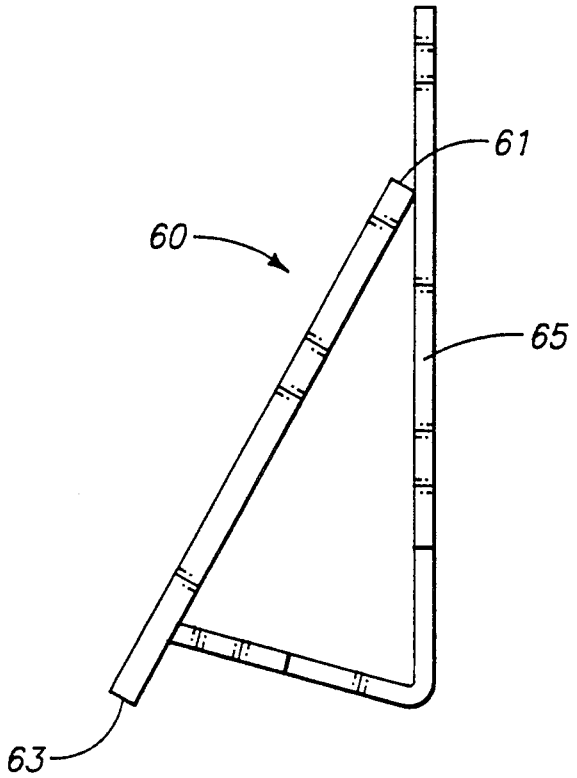
FIG. 7 is an end elevation view of the back wall.
Figure 8:
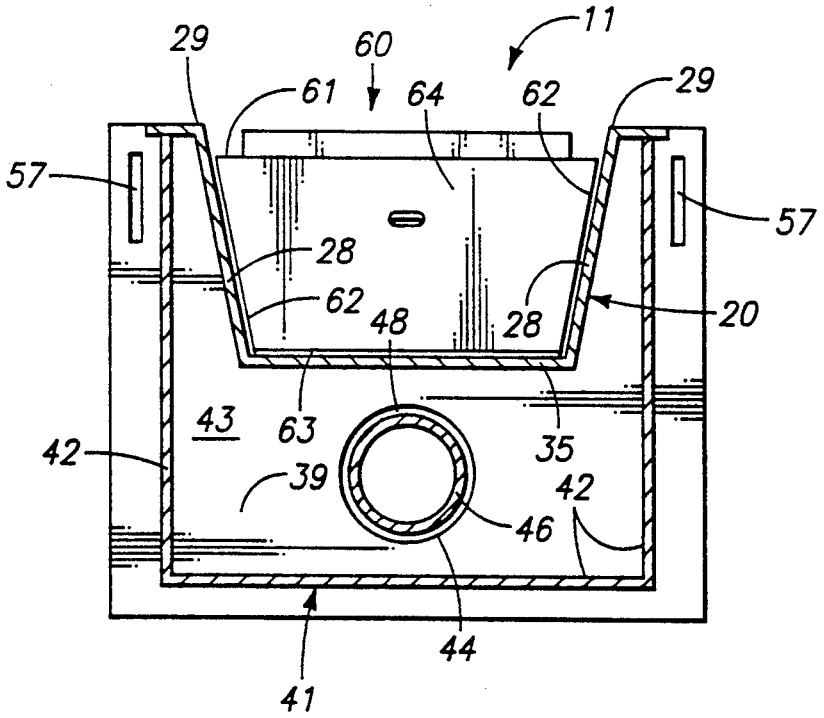
FIG. 8 is an end sectional view of the burn pot taken substantially along line 8—8 in FIG. 3.
Figure 9:
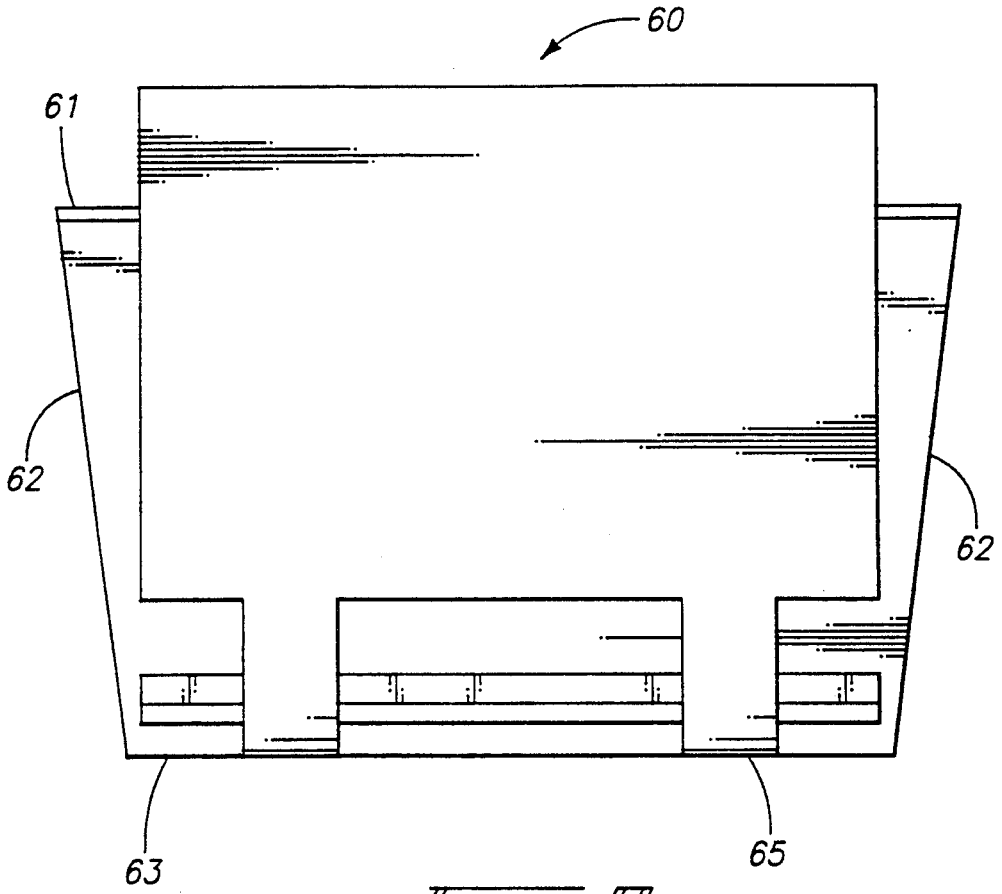
FIG. 9 is a rear elevation view of the back wall.
Figure 10:
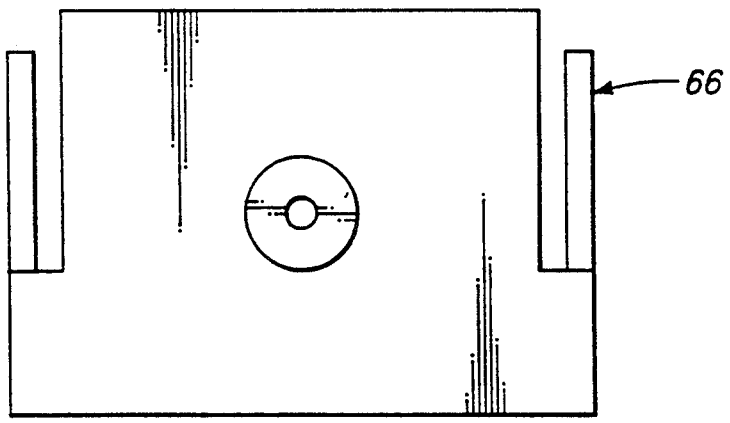
FIG. 10 is a rear elevation view of a hanger bracket for the back wall.

The burn pot body 20 also includes a combustion air plenum 41 that surrounds the side walls 28, bottom wall 35, and at least a portion of the front wall 23. The plenum 41 is comprised of plenum walls 42 that are similar to the burn pot side walls 28, bottom wall 35, and front wall 23. The walls 42 are spaced outwardly of the respective walls 23, 28 and 35 to provide an air space for plenum area 43 through which air may be drawn to be discharged through the various openings 25, 31, and 37 as described above. The back edges of the plenum and burn pot walls are joined by a back plenum wall 39 (FIGS. 4, 5, and 8).

The back wall 39 of the air plenum includes a hole 44 for receiving a combustion air tube 46. Such tube is connected to duct 47 leading to the external ambient air. It should also be pointed out that the hole 44 could be connected to a positive pressure fan or blower, depending upon the construction of the associated burner 10. In either situation, air will be delivered by either positive or negative pressure (suction or draft) through the plenum 41 and the various openings to support combustion within the burn pot.

A substantially air-tight connection about hole 44 and the tube 46 may be provided by gasket 48 mounted on a bracket 49 (FIGS. 3–5) that may be mounted between the burn pot 11 and the adjacent rearward wall of the burner firebox 12. Bracket 49 includes rearward edges 51 for attachment with the firebox wall and a forward edge or stop 50 for abutment with the back plenum wall 39.

In the preferred form, the burn pot body 20 is removably mounted within the firebox 12 by provision of a burn pot hanger 55 attached to the appropriate firebox wall. The hanger 55 includes forwardly projecting hooks 56 (FIG. 5). The hooks 56 engage flanges of the back plenum wall 39, through upright slots 57 (FIG. 8) therein. The slot and hook arrangement facilitate ease in mounting and dismounting of the burn pot to the firebox wall. The hooks 56 can be fitted through the slots 57 which permit the burn pot to be pivoted downwardly, or lifted upwardly as shown diagrammatically by dashed lines in FIG. 4. These features allow the burn pot to be easily removed for cleaning, repair or replacement as desired.

The back wall 60 forms a part of the burn pot but is separable from those parts of the burn pot body as described to this point. Back wall 60 is provided within the burn pot 11 to move substantially translationally between the side walls 28 toward and away from the front wall 23. In the preferred form the back wall 60 is inclined, extending from a top edge 61 along side edges 62 that are complementary to, but spaced inwardly of the side walls 28, to a substantially horizontal bottom edge 63 which is slidably engaged with the bottom wall 35.

The back wall top edge 61 is spaced rearwardly, toward the rearward edges of the burn pot body from the bottom edge 63. Thus, the back wall is inclined opposite to the inclination of the burn pot body front wall 23. The angle of the back wall to the burn pot bottom wall 35 is approximately 60°. The back wall acts as a pusher to move particulates including ash toward the stationary front wall and up its inclined surface. The back wall 60, side walls 28 and bottom wall 35 together form an upwardly open combustion bowl area 64 for receiving particulate fuel.

Figure 11:
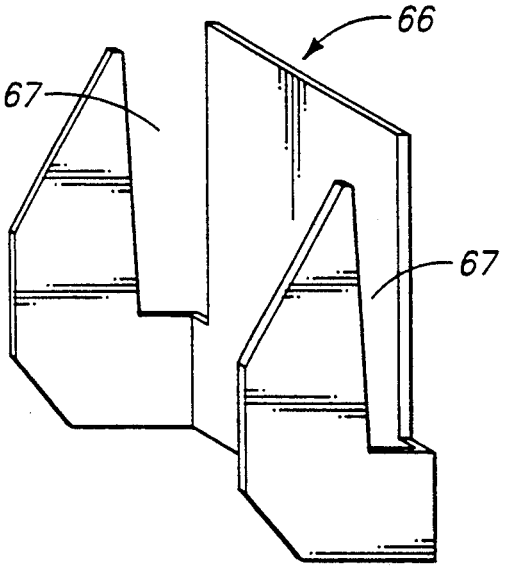
FIG. 11 is a perspective view of the hanger bracket.
Figure 12:
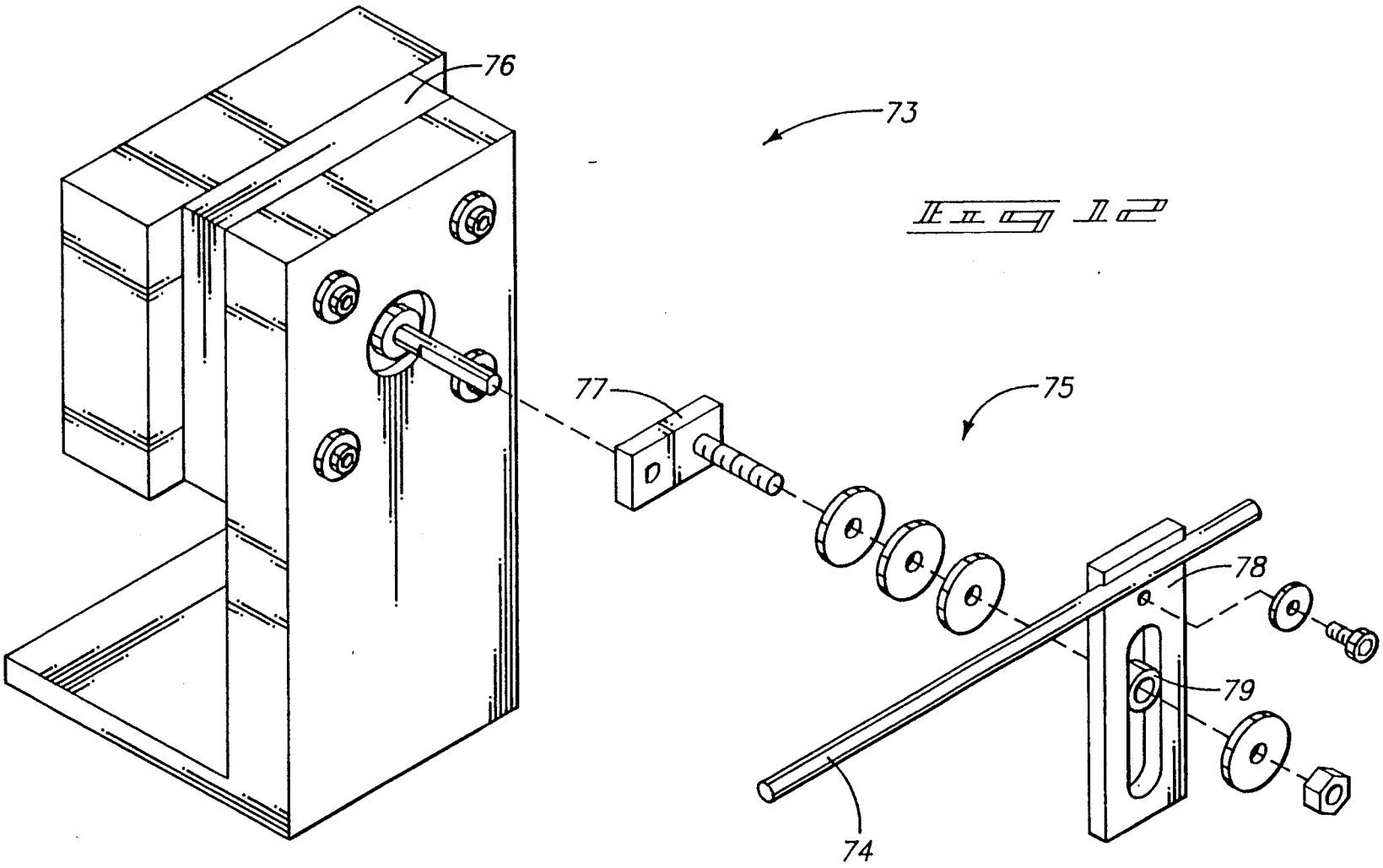
FIG. 12 is an exploded perspective view of a driver for the back wall.

In the preferred form, back wall 60 is provided with a rearwardly extending brace member 65 which is used for holding the back wall in its inclined angular orientation. The brace member is releasably received by a hanger bracket 66 (FIGS. 4, 5, and in detail in FIG. 11). Upwardly open angled notches 67 loosely receive the brace member 65 to ease removal of the back wall 60 for cleaning, repair, or replacement. The angled notch will also allow "play" or movement of the back wall 60 relative to the hanger bracket 66. Such tolerances accommodate expansion and contraction during different temperature operations, permit movement of the back wall 60 relative to the hanger bracket 66 should obstacles be encountered in its forward and rearward reciprocating motion.

The dimensions across the face of the back wall 60 are less than the dimensions of the complementary configuration of the burn pot. In other words, the side edges 62 are spaced inwardly from the adjacent side walls 28 of the burn pot body. This allows relative movement, including misalignment of the back wall during reciprocating motion of the back wall between the side walls and thereby assures that binding will not occur.

The back wall 60, in the preferred form is moved by a driver 73 (FIGS. 2, 12) in a reciprocating manner forward and rearwardly along the plane of the bottom wall 35. The preferred driver 73 is a form of linear actuator which, in the example shown, includes a rod 74 that is mounted to the hanger bracket 66 and extends rearwardly through a guide 72 on the firebox wall to a reciprocating drive mechanism generally shown at 75. In a more specific example, the mechanism 75 is a motor 76 for rotating a bellcrank 77. A slotted cross head 78 is attached to the rod 74 and is connected to the bellcrank by a roller 79 that rides within the slot of the cross head. Rotation of the bellcrank will therefore cause linear motion of the slotted cross head 79 and the attached rod 74. The rod 74, in turn, will move the back wall hanger bracket 66 and the back wall 60 mounted thereon in a linear reciprocating motion, the extremes of which are shown in FIGS. 4 and 5. In FIG. 4 the back wall is in its rearward extreme condition and in FIG. 5 the back wall is shown in its forward extended position.

It is contemplated that other driver mechanisms may also be used. For example, a simple rack and pinion mechanism could also be used to provide linear motion of the back wall in a defined forward and rearward stroke. A lead screw drive mechanism could also perform the function, as well as other linear motion mechanisms.

From the above discussion of the technical details of the present burn pot assembly, operation may now be easily understood. Prior to operation, the burn pot is installed within the appropriate burner by simply attaching the slotting flanges to the hooks 56 on the hanger 55. The hanger 55 is mounted within the firebox 12 adjacent the feeder 14 such that positioning of the burn pot on the hanger will locate the burn pot for reception of particulate fuel from the feeder 14. Bracket 49 and combustion air tube are also mounted to the firebox to join with the combustion air plenum of the burn pot through hole 44. The driver unit is also mounted with the rod 74 extending through the guide 72 on the firebox wall to mount the back wall hanger bracket. The burn pot may now be installed.

Installation is accomplished simply by lowering the burn pot body 20 into position as shown by dashed lines in FIG. 4, with the flange slots 57 received over the hooks 56. The burn pot body can then be pivoted down to the operative position where the tube 46 of the combustion air supply is received through the complementary hole 44 in the rearward portion of the burn pot. The gasket 48 seals against the adjacent walls of the burn pot and the tube to effectively prevent air leakage from the plenum area. Next, the back wall 60 may be installed simply by fitting the brace member 65 into the angled notches 67 of the back wall hanger bracket 66. The burn pot 11 is now installed and ready for operation.

A fire may be started within the combustion bowl area 64 in a manner common to particulate burners. Once the fire is started, additional pellets are fed into the burn pot by the feeder mechanism 14. The rate of feed for pellets depends upon the heat desired. More pellets are fed for a hotter fire and fewer for low fire conditions. The pellets drop into the combustion bowl area 64 and rest on the bottom wall 35. As combustion continues, the driver 73 may be periodically operated either by manual or automatic controls, to move the back wall in a forward and rearward stroke.

The back wall 60 will go from its rest position toward the opposite inclined front wall until it passes over the forward row of openings 37. It then returns it to its rest position. During the first half of this cycle, the wall 60, which is in physical contact with the bottom of the burn pot, pushes all the burning fuel, ashes, and clinkers toward and up the inclined front wall. Ashes and clinkers which are blocking the entrance of combustion air from the holes in the bottom of the burn pot are cleared. When the back wall 60 returns to its retracted rest position, the fuel returns to the vacated area over the bottom of the burn pot and continues burning. The ash remains on the inclined wall and clinkers become embedded in the ash. Eventually, with repeated cycles of the moveable wall, the ash and embedded clinkers are shoved up and over the inclined wall, clear of the burn pot for collection and disposal.

On low burns, the back wall keeps moving the particulates toward the bottom of the inclined wall. The particulates are kept in closer proximity to each other with the result that the fire is less likely to die out and combustion is more complete and uniform.

A still further advantage is understood from the reciprocating motion of the back wall, somewhat "stirring" the particulates to create a thorough burn of the particulate materials.

In compliance with the statue, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A pellet burn pot for a particulate fuel burner having a firebox, a hopper and a particulate feeder for dropping particulate fuel into the firebox, the burn pot comprising:

a burn pot body including a front wall, side walls joining the front wall, and a bottom wall joining the front and side walls, the walls defining a combustion bowl area;

said burn pot body being adapted to be positioned in a firebox to receive particulate fuel from a particulate feeder;

wherein the front wall is inclined away from the bottom wall and includes an upper ash discharge edge;

a back wall slidably mounted to the side and bottom walls and facing the front wall; and a driver for moving the back wall in a reciprocating movement along the bottom wall and side walls toward, and away from the front wall, to engage and move particulates along the bottom wall and side walls toward the front wall and the discharge edge thereof.

2. A burn pot for particulate fuel burners, as defined by claim 1, further comprising:

a combustion air plenum formed about the burn pot body, including the front, side, and bottom walls thereof; and wherein said burn pot body walls include openings leading into said combustion air plenum to deliver combustion air from the plenum into the combustion bowl area.

3. A burn pot as defined by claim 1, further comprising:

a hanger adapted to be mounted to the particulate fuel burner and including hooks releasably engaging the burn pot to releasably support the burn pot within the firebox.

4. A burn pot as defined by claim 1, further comprising:

a hanger bracket on the driver releasably mounting the back wall such that the back wall may be lifted therefrom.

5. A burn pot as defined by claim 1, wherein the back wall is inclined opposite to the front wall.

6. A burn pot for particulate fuel burners, as defined by claim 1, wherein the bottom wall is substantially horizontal and wherein the driver is positioned to move the back wall substantially horizontally along the bottom wall and between the side walls.

7. A burn pot for particulate fuel burners, as defined by claim 1 wherein the back wall includes side edges complimentary to and spaced inwardly of the side walls and a bottom side edge joining the side edges and complimentary to the bottom wall.

8. A burn pot for particulate fuel burners, as defined by claim 1, wherein the back wall includes a brace member thereon holding the back wall at an inclined angle opposed to the inclination of the front wall, and slidably supporting the back wall on the bottom wall.

9. A burn pot for particulate fuel burners, as defined by claim 1, wherein the side walls extend from the front wall rearwardly to rearward edges, and wherein the back wall is forward of the rearward edges of the side walls.

10. A burn pot for particulate fuel burners, as defined by claim 1, further comprising:

a combustion air plenum formed about the burn pot body, including the front, side, and bottom walls; and said side walls including openings leading into said combustion air plenum to deliver combustion air from the plenum into the combustion bowl area;

wherein the side walls extend from the front wall rearwardly to rearward edges, and wherein the back wall is forward of the rearward edges of the side walls.

11. A burn pot for particulate fuel burners, as defined by claim 1, wherein the back wall includes side edges complimentary to and spaced inwardly of the side walls and a bottom side edge joining the side edges and slidably engaging the bottom wall; and a top edge substantially elevationally even with the discharge edge of the front wall.

12. In a particulate fuel burner:

a firebox defined by firebox walls;

a particulate feeder for dropping particulate fuel into the firebox;

a burn pot body including a bottom wall, a front wall, and side walls joined to a front wall and bottom wall, defining a combustion bowl area, wherein the side and front walls include upper edges, for receiving particulate fuel dropped by the particulate feeder;

a bracket on one of the firebox walls releasably supporting the burn pot body to receive particulate fuel from the feeder;

a back wall slidably mounted within the burn pot body adjacent to the side and bottom walls and facing the front wall; and a driver mounting the back wall to move the back wall in a reciprocating movement within the combustion bowl area along the bottom and side walls toward and away from the front wall, to engage and move particulates along the bottom wall and side walls toward the front wall and the discharge edge thereof.

13. In a particulate fuel burner, as claimed by claim 12, wherein the burn pot further comprises:

a combustion air plenum formed about the front, side, and bottom walls of the burn pot body; and wherein the burn pot body walls include openings leading into said combustion air plenum to deliver combustion air from the plenum.

14. In a particulate fuel burner, as claimed by claim 12, further comprising:

a burn pot hanger mounted to the firebox and including hooks releasably engaging the burn pot to releasably support the burn pot within the firebox.

15. In a particulate fuel burner, as claimed by claim 12, further comprising:

a hanger bracket on the driver releasably mounting the back wall such that the back wall may be lifted from the burn pot.

16. In a particulate fuel burner, as claimed by claim 12, wherein the side walls include openings leading into said combustion air plenum to deliver combustion air from the plenum into the combustion bowl area; and wherein openings in the side and bottom walls are positioned in the reciprocating path of the back wall.

17. In a particulate fuel burner, as claimed by claim 12, wherein the front wall is inclined away from the back wall.

18. A burn pot for particulate fuel, comprising:

a burn pot body including a front wall, side walls joining the front wall, and a bottom wall joining the front and side walls;

wherein the front wall is inclined away from the bottom wall and includes an upper ash discharge edge; and a back wall slidably engaging the side and bottom walls and facing the front wall for movement between the side walls and along the bottom wall toward and away from the front wall.

19. A burn pot for particulate fuel as claimed by claim 18 further comprising:

a combustion air plenum formed about the burn pot body, including the front, side, and bottom walls thereof; and said front, side and bottom walls including openings leading into said combustion air plenum to deliver combustion air from the plenum.

20. A burn pot for particulate fuel as claimed by claim 18 wherein said front, side and bottom walls include air delivery openings.

* * * * *